US010214305B2

(12) United States Patent
Last et al.

(10) Patent No.: US 10,214,305 B2
(45) Date of Patent: Feb. 26, 2019

(54) ASSEMBLY MACHINE ADAPTED TO ASSEMBLE CAPS ONTO SPOUTS AND A METHOD OF ASSEMBLING CAPS ONTO SPOUTS

(71) Applicant: IPN IP B.V., DC Houten (NL)

(72) Inventors: Laurens Last, Monaco (MC); Willem Jan Adriaan Oosterling, SL Loon Op Zand (NL)

(73) Assignee: Scholle IPN IP BV (NL)

( * ) Notice: Subject to any disclaimer, the term of this patent is extended or adjusted under 35 U.S.C. 154(b) by 406 days.

(21) Appl. No.: 15/114,627

(22) PCT Filed: Jan. 30, 2015

(86) PCT No.: PCT/NL2015/050053
§ 371 (c)(1),
(2) Date: Jul. 27, 2016

(87) PCT Pub. No.: WO2015/115891
PCT Pub. Date: Aug. 6, 2015

(65) Prior Publication Data

US 2016/0355281 A1 Dec. 8, 2016

(30) Foreign Application Priority Data

Jan. 30, 2014 (NL) ..... 2012170

(51) Int. Cl.
*B65B 7/02* (2006.01)
*B65B 61/18* (2006.01)
*B65B 7/28* (2006.01)

(52) U.S. Cl.
CPC ..... *B65B 7/02* (2013.01); *B65B 7/28* (2013.01); *B65B 7/2807* (2013.01); *B65B 7/2835* (2013.01); *B65B 61/186* (2013.01)

(58) Field of Classification Search
CPC ... B65B 61/186; B65B 7/2835; B65B 7/2807; B65B 7/28; B65B 7/02; B29C 65/56;
(Continued)

(56) References Cited

U.S. PATENT DOCUMENTS 2,660,968 A 12/1953 Livacich
3,024,523 A * 3/1962 Donaldson ..... B65B 7/01 29/785

(Continued)

FOREIGN PATENT DOCUMENTS

EP 1683625 A1 7/2006

*Primary Examiner* — Robert Long
*Assistant Examiner* — Xavier A Madison
(74) *Attorney, Agent, or Firm* — The Watson IP Group, PLC; Jovan N. Jovanovic; Vladian M. Vasiljevic

(57) ABSTRACT

The present invention relates to an assembly machine adapted to assemble caps (3) onto spouts (2) and a method of assembling caps onto spouts, wherein use is made of such an assembly machine. The assembly machine comprises a spout supply (10), a cap supply (20) and a frame comprising a cap guide arc (30). The frame further comprises a turret assembly (40) comprising a circular spout transporter (41), a cap positioning element (42) provided above the cap guide arc (30) and a cap assembly unit (43) provided above the spout transporter (41). The cap assembly unit (43) is adapted to pick up the cap at a pick-up position (C) and assemble the cap onto the spout at an assembly position (D).

10 Claims, 6 Drawing Sheets

(58) Field of Classification Search
CPC ... B29C 65/561; B29C 65/7867; B29C 65/58; B29C 65/562
USPC ..... 53/410, 133.2; 439/67, 75, 210, 84; 222/566
See application file for complete search history.

(56) References Cited

U.S. PATENT DOCUMENTS 3,518,744 A 7/1970 Boyd
5,031,295 A * 7/1991 Schmitt ..... B23P 21/006 29/33 J

* cited by examiner

ASSEMBLY MACHINE ADAPTED TO ASSEMBLE CAPS ONTO SPOUTS AND A METHOD OF ASSEMBLING CAPS ONTO SPOUTS

The present invention relates to an assembly machine adapted to assemble caps onto spouts and a method of assembling caps onto spouts.

The assembly machine is adapted to form a pre-assembled closure assembly that is to be sealed in an opening between two walls of a collapsible pouch. In addition, the assembly machine is also adapted to assemble caps onto spouts that have been sealed in an opening between two walls of a collapsible pouch. Hence, a closure is formed onto spouts that are sealed to pouches, preferably filled pouches.

Various assembly machines are known in the art, both for forming pre-assembled closure assemblies and for forming closures onto a spout that is sealed to a pouch, preferably a filled pouch. E.g. machines with continuous rotary models are known, comprising a pick and place assembly system.

The present invention aims to provide an improved assembly machine for assembling caps onto spouts, or at least to provide an alternative for known assembly machines.

The present invention provides an assembly machine adapted to assemble caps onto spouts according to claim 1, the assembly machine comprising

- a spout supply adapted to supply spouts in succession at a spout supply position;
- a cap supply adapted to supply caps in succession at a cap supply position;
- a frame comprising:
  - a cap guide arc, mounted stationary in the frame, which cap guide arc is adapted to receive each cap from the cap supply and to guide the cap between the cap supply position and a cap pick-up position;
  - a turret assembly which is rotatable about an essentially vertical rotation axis, which is provided along and adjacent to the spout supply position, the cap supply position and the cap guide arc, the turret passing, in the direction of rotation, the cap supply position, the cap pick-up position, an assembly position in which cap and spout are assembled and an assembled cap-and-spout expelling position wherein the assembled cap-and-spout is expelled from the turret assembly, the turret assembly comprising:
    - a circular spout transporter, provided with spout receptacles each adapted to receive a spout from the spout supply at the spout supply position, the spout transporter being adapted to transport each spout at least between the spout supply position, via the assembly position, towards the expelling position,
    - a cap positioning element provided above the cap guide arc in an operative position thereof, the stationary cap guide arc being provided above and parallel to and having the same radius as the spout transporter, the cap positioning element being adapted to position the cap in, and guide the cap along the cap guide arc in the operative position thereof between the cap supply position and the cap pick-up position, the cap positioning element being retractable to a non-operative retracted position when remote from the cap guide arc,
    - a cap assembly unit provided above the spout transporter, the rotation path of which being parallel to and having the same radius as the spout transporter, the cap assembly unit being adapted to pick up the cap at the pick-up position and assemble, e.g. screw or click the cap onto the spout at the assembly position, the cap assembly unit being movable up-and-down between a non-operative upper level, via a lower-situated pick-up level at the cap pick-up position to a lowermost assembly level at the assembly position.

The assembly machine according to the invention is possibly adapted to assemble caps onto spouts to form a pre-assembled closure assembly that is to be sealed in an opening between two walls of a collapsible pouch. Alternatively, the assembly machine according to the invention is also adapted to assemble caps onto spouts that have been sealed in an opening between two walls of a collapsible pouch, preferably a pre-filled collapsible pouch.

In embodiments the assembly machine allows for improved and/or alternative assembly of caps onto spouts. For example, as will be explained also with reference to embodiments, accurate relative positioning of the caps and spouts is accomplished.

The spout comprises a passage for delivering a medium from the pouch and/or feeding a medium to the pouch. In a bottom part thereof, the spout, on opposite sides, forms a sealing zone for a sealed connection to the adjoining foil walls of a collapsible pouch.

The spout is preferably an injection moulded plastic body, which is, or is intended to be sealed between two foil walls of a pouch. Such pouches composed of interconnected thin foil walls are well known in the art as packaging material for flowable products, e.g. food products or refill packages for products such as soap.

In the prior art, spouts with a rigid bottom part are known, which may be embodied as a solid block, but alternatively sealing walls having on its exterior multiple parallel ribs above one another are is known in the art. Examples of patent applications in which such rigid type of bottom parts are WO 00/66448 and EP 0 800 994. Also spout bodies with a flexible bottom part are known, the sealing zones being formed by downwardly extending thin, flexible sealing walls.

In a practical embodiment sealing wall, e.g. a cylindrical sealing wall, is provided with two diametrically opposed fins thereon which extend in a common plane, the fins being sealed between the opposed film walls of the pouch as is known in the art.

The sealing process involves pressing the foil walls of the pouch onto the sealing zone of the spout body using pressure-exerting means. In this process the exterior of the sealing zone and the foil wall are melted and also pressure is exerted by the pressure-exerting means.

In a practical embodiment the bore of the spout base is circular, e.g. formed by a cylindrical sealing wall extending around the circular bore. In another embodiment, which prevents rotation of the inner part relative to the spout base, the bore is non-circular, e.g. oval, hexagonal, etc.

In an embodiment the spout is provided with a radially protruding flange above the sealing wall, e.g. so as to extend over the top rim of the walls of the pouch. The flange may be used for handling the pouch.

The cap is preferably a rotational cap, preferably a screw cap, that is injection moulded of plastic material. In an embodiment, the cap is provided with a tamper-evident ring to identify first user proof. E.g. the tamper-evident ring is integrally formed as a part the plastic screw cap. Preferably, the tamper-evident ring is non-grippable to reduce the choking hazard.

In an embodiment, the screw thread of a cap is provided with an end stop to avoid overscrewing of the cap onto the spout.

An example of a possible cap is shown in EP2380820. Alternatively, the cap is an anti-choke hazard wing cap, e.g. as disclosed in U.S. Des. Pat. No. 687,719 of the same applicant. The cap positioning element of the invention is allowed to abut the wings in the operative position thereof, to define the orientation of the wing cap at the pick-up position before assembly, and as such, damage of the wings is prevented.

The assembly machine according to the invention comprises a spout supply and a cap supply, adapt to supply spouts and caps respectively, in succession. Such a supply may e.g. comprises one or more of a centrifugal feeder, a linear feeding line, a separation wheel. Such cap and spout supplies are commonly known in the art. The caps are supplied to a cap supply position, distinct from a spout supply position to which the spouts are being supplied.

The assembly machine further comprises a frame, onto which a cap guide arc and a turret assembly are mounted. The turret assembly comprises a circular spout transporter, a cap positioning element provided above the cap guide arc in an operative position thereof and a cap assembly unit. The turret assembly is rotatable about an essentially vertical rotation axis, which is provided along and adjacent to the spout supply position, the cap supply position and the cap guide arc. It is conceivable that the frame comprising cap guide arc and turret assembly is positioned at an angle with respect to the vertical, e.g. up to 45°, in which the relative terms 'above' and 'up and down' describing the invention should be interpreted at an angle as well.

The turret assembly passes, in the direction of rotation, the cap supply position, the cap pick-up position, an assembly position in which cap and spout are assembled and an assembled cap-and-spout expelling position wherein the assembled cap-and-spout are expelled from the turret assembly. The spout supply position may be at any position prior to the assembly position, seen in direction of rotation.

The circular spout transporter rotates with the rotatable turret assembly and upon rotation, it is adapted to transport each spout at least between the spout supply position, via the assembly position, towards the expelling position. To this end, the spout transporter is provided with spout receptacles, which are each adapted to receive a spout from the spout supply at the spout supply position. The spout receptacles are e.g. embodied as pins onto which spouts are placed, in particular onto which the passage for delivering and/or feeding a medium from or to the pouch is placed. Alternatively, the spout receptacles may be embodied as slides, preferably having a configuration adapted to or matching the shape of the spout, e.g. in the case of ribbed spouts.

In an embodiment, the spouts are fixated in position on the spout transporter by little notches on the inside of the spout.

In a preferred embodiment, a spout fixation member is provided above, preferably adjacent or very close to the spout transporter, which is rotatable together with the spout transporter, and which is adapted to fixate a spout at the assembly position in an operative position. The spout fixation member is retractable to a non-operative retracted position remote from the assembly position. Fixation of the spout ensures an exactly known position of the spout, which is advantageous, e.g. to optimize the position of the cap to be screwed onto the spout to give the shortest way of screwing and result in the shortest screwing time. Furthermore, over- and underscrew can be avoided by knowing both the position of the cap and of the spout exactly.

Such a spout fixation member is particularly advantageous in combination with a spout being provided with a radially protruding flange above the sealing wall, e.g. so as to extend over the top rim of the walls of the pouch.

The cap positioning element is provided above, preferably adjacent or very close to the cap guide arc and is rotatable together with the turret assembly to position the cap in, and guide the cap along the cap guide arc in an operative position thereof. The cap positioning element is retractable to a non-operative retracted position when remote from the cap guide arc.

Both the spout fixation member and the cap positioning element may e.g. be embodied as a plate or rod having a 'forked' end portion, wherein the spout or the cap is positioned and fixated in a indentation between the forks.

The cap positioning element, and possibly also the spout fixation member, are retractable to a non-operative retracted position. In this retracted position, e.g. having a reduced radius, the cap positioning element, and possibly also the spout fixation member, remain rotatable together with the turret assembly, but are no longer in contact with spout or cap and are non-operative in that respect.

The cap guide arc is mounted stationary to the frame, at a position above and parallel to and having the same radius as the spout transporter. The cap positioning element is provided above the cap guide arc. The length of the cap guide arc may be between a quarter and three quarters of a circle. The cap guide arc extends at least between the cap supply position and the cap pick-up position, but preferably not to the assembly position. Hence, the cap guide arc ends once the caps are picked up by the cap assembly unit. Once picked up by the assembly unit, the function of the cap guide arc is redundant.

In an upward direction, the turret assembly comprises the spout transporter at the lowermost level, an optional spout fixation member there above, then the cap guide are and thereabove the cap positioning element. Even further above the cap positioning element a cap assembly unit is provided in the operative position thereof. The rotation path of the cap assembly unit is parallel to and has the same radius as the spout transporter and the cap guide arc.

The cap assembly unit is adapted to pick up the cap at the pick-up position and assemble the cap onto the spout at the assembly position, e.g. screw or click the cap onto the spout. The cap assembly unit is rotatable with the turret assembly. In addition, the cap assembly unit is movable up-and-down between a non-operative upper level, at least above the cap supply position, via a lower-situated pick-up level at the cap pick-up position to a lowermost assembly level at the assembly position. Preferably, the cap guide arc does not extend to this assembly position, allowing the cap assembly unit to move downwards uninterrupted in a straight line.

In an embodiment, the cap assembly unit comprises a servo driven motor. Alternatively, an electromagnetic clutch may be applied. The cap assembly unit is advantageously provided with a screwing head. In an embodiment, a position encoder is provided to determine the exact position of the screwing head. This may advantageously comprise both the position in vertical direction, and its rotational position. For example, this is advantageous in combination with the known position of the spout, allowing the cap to be optimally rotatably positioned during the lowering down of the cap assembly unit, to enable the shortest way of screwing resulting in the fastest screwing time. The exactly known position also attributes in preventing over- and underscrewing the cap. Furthermore, damage to the caps is prevented.

The configuration of the screwing head is advantageously adapted to the cap that is to be screwed: it may comprise openings for receiving wings of a winged cap, or it may encircle caps symmetrically on geometry.

The present invention also relates to a method of assembling caps onto spouts, wherein use is made of an assembly machine according to claim 1. The method comprises the steps of:

- supplying spouts by a spout supply in succession at a spout supply position;
- supplying caps by a cap supply at a cap supply position;
- a cap guide arc receiving each cap from the cap supply and guiding the cap between the cap supply position to a cap pick-up position;
- a circular spout transporter provided with spout receptacles receiving each spout from the spout supply at the cap supply position and transporting each spout at least from the spout supply position, via the assembly position, to the expelling position,
- a cap positioning element positioning the cap in, and guiding the cap along the cap guide arc between the cap supply position and the cap pick-up position,
- the cap positioning element retracting to a retracted position having a reduced radius when remote from the cap guide arc,
- a cap assembly unit moving down from a non-operative upper level, via a lower-situated pick-up level, picking up the cap at the pick-up position, to a lowermost assembly level, assembling the cap onto the spout at the assembly position, e.g. screwing or clicking;
- expelling the assembled cap-and-spout from the turret assembly at the assembled cap-and-spout expelling position.

In an embodiment the method further includes the step of:

- sealing a spout in an opening between two walls of a collapsible pouch;
- filling each of the collapsible pouches.

It is conceivable that first the spout is sealed to the pouch, and the pouches is filled subsequently through the spout. Alternatively, it is also conceivable that the pouch is provided in a state with a single opening at the top, wherein prior to arranging of the spout in this opening the pouch is filled with a product, e.g. a food product, wherein after the step of filling the pouch, the spout is arranged in the opening and the sealing of the spout therein is performed in one or more sealing steps. The provision of the cap is a final step in this embodiment.

The invention will now be explained in more detail with reference to the drawings. In the drawings.

Figure 1:
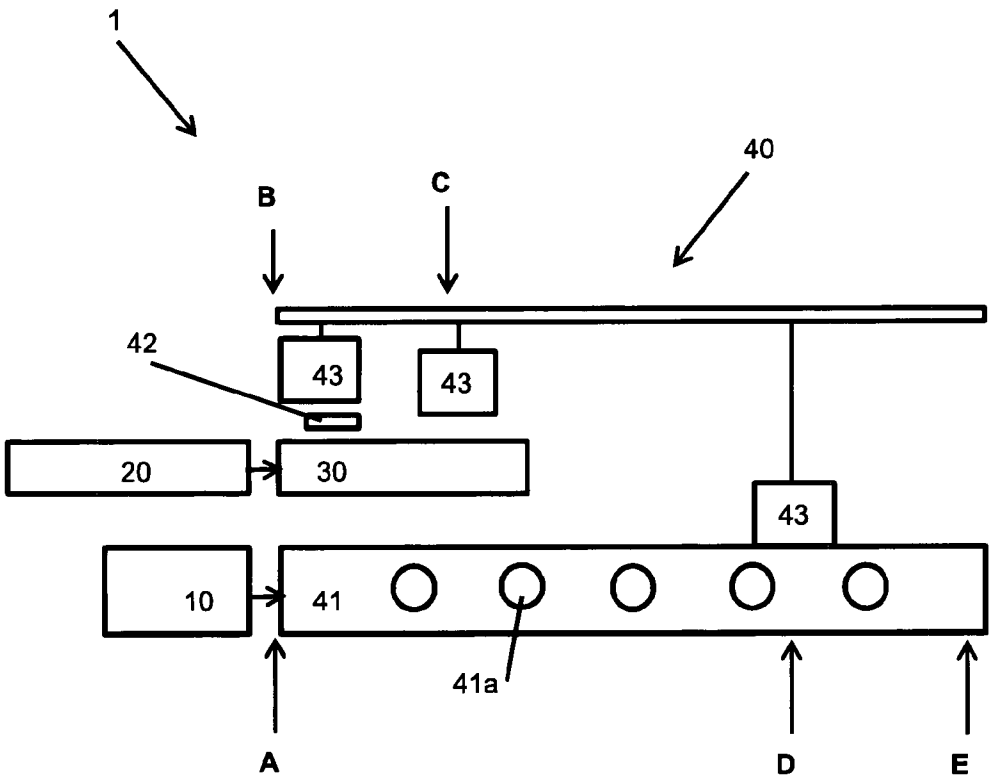
FIG. 1 shows schematically an assembly machine according to the invention.
Figure 2:
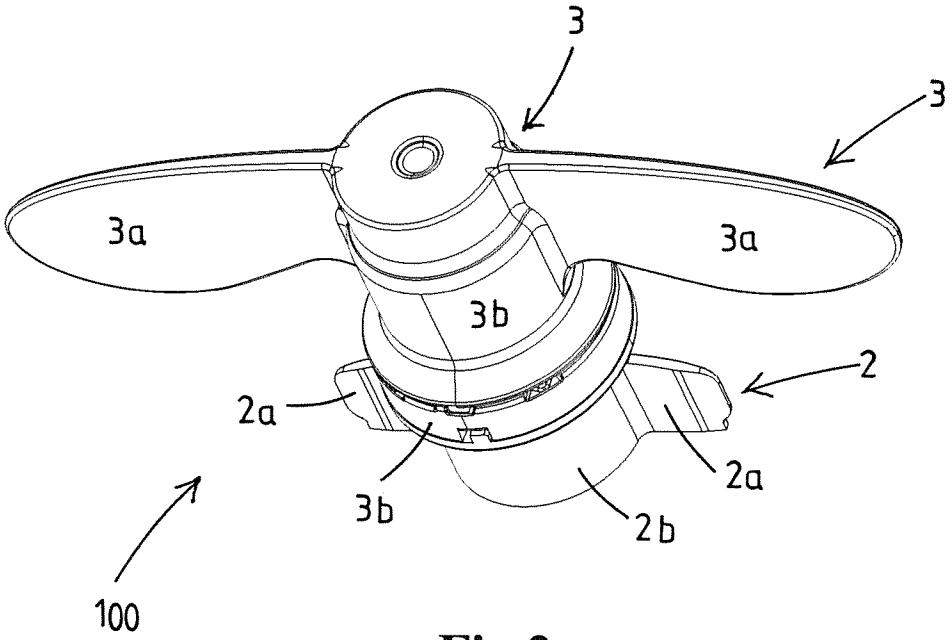
FIG. 2 shows in a perspective view an embodiment of a cap, adapted to be assembled onto a spout with the assembly machine of the invention.

In FIG. 1 very schematically an assembly machine 1 is shown, adapted to assemble caps 3 onto spouts 2. In FIG. 2, an example of a cap pre-assembled closure assembly 100 is shown, formed on an assembly machine according to the inventions, that is to be sealed in an opening between two walls of a collapsible pouch. In FIGS. 3A-3E, in perspective view various aspects of an assembly machine are shown in detail, and in FIG. 4. an assembly machine is shown in cross-section. In all FIGS. 1-4 the same reference numbers have been used to denote the same elements.

The assembly machine 1 comprises a spout supply 10 adapted to supply spouts 2 in succession at a spout supply position A. A cap supply 20 is provided to supply caps 3 in succession at a cap supply position B. The assembly machine 1 further comprises a frame 25 comprising a stationary cap guide arc 30 and a rotatable turret assembly 40.

The shown cap supply 20 and spout supply 10 comprise centrifugal feeders (not visible). The spouts are fed into a linear feeding line 11. E.g., the linear feeding line 11 is a stainless steel line. E.g., air blow transport is applied to supply the spouts. The spouts are fed into a separation wheel 12 and subsequently fed into the turret assembly 40.

The caps are fed by a linear feeding line 21 into a rotary wheel 22. In the rotary wheel, in this embodiment, the caps are fixed into position by cam driven positioning shafts 23.

The shown caps 3 are wing caps, wherein the purpose of the wings is to provide non-choke hazard, e.g. according to NEN EN 71.1 (small parts cylinder). As shown in an enlarged view in FIG. 2, the cap 3 is a wing cap comprising wings 3*a*. Furthermore, the cap is provided with a tamper-evident ring 3*b* to identify first user proof.

Figure 3A:
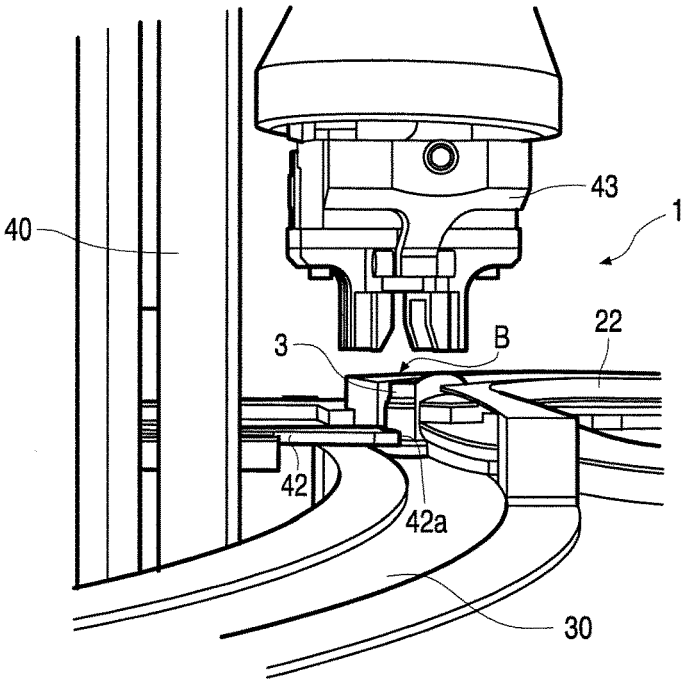
FIGS. 3A-3E show in perspective view various aspects of an embodiment of the assembly machine of the invention.
Figure 3B:
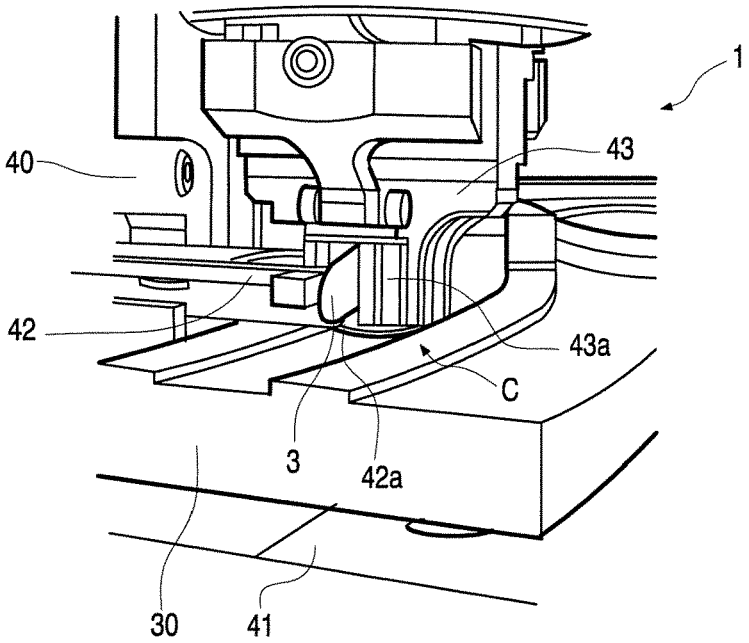
Figure 4:
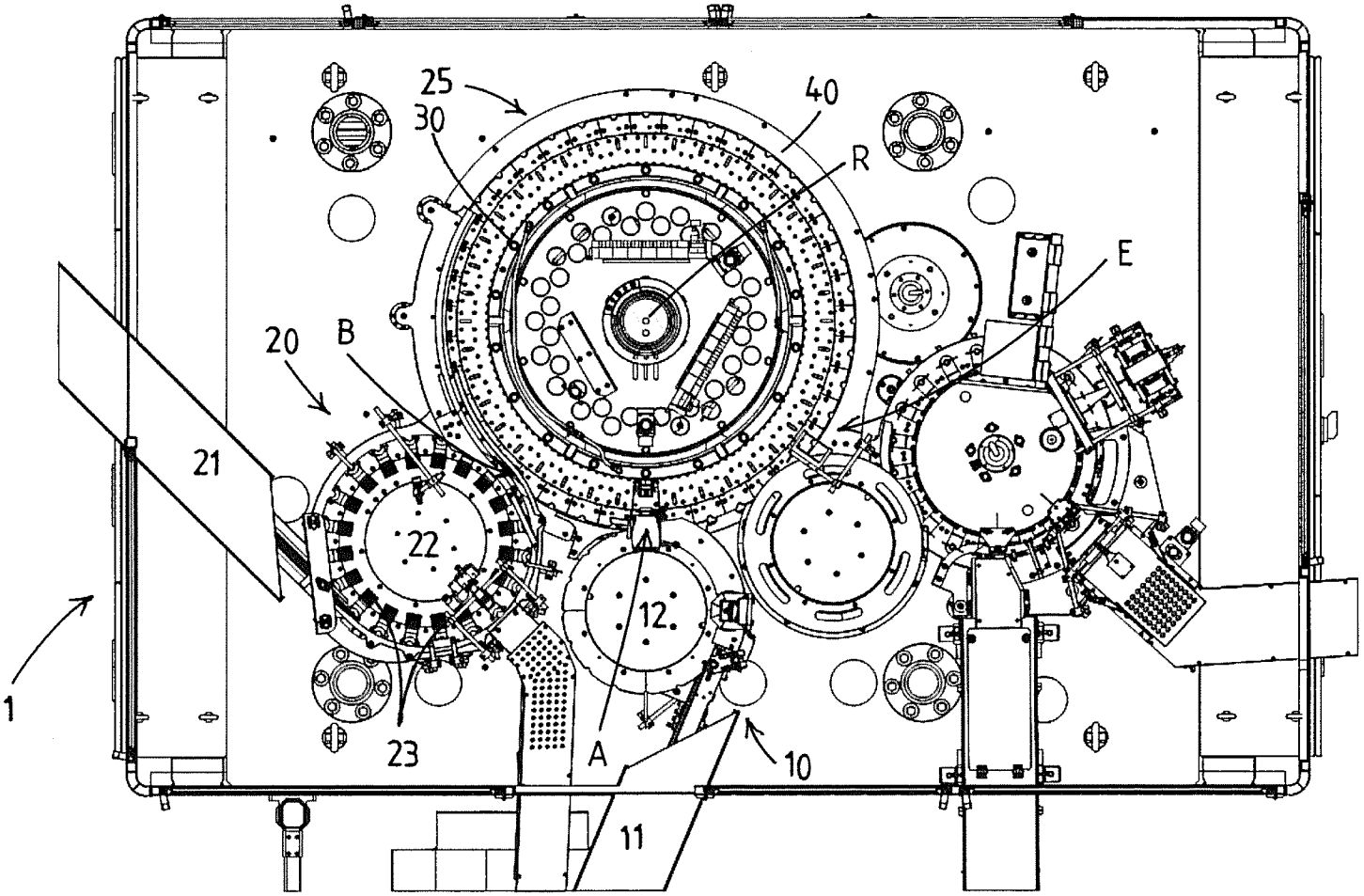
FIG. 4 shows a cross section of an embodiment of an assembly machine of the invention.

The cap guide arc 30, mounted stationary in the frame, is adapted to receive each cap 3 from the cap supply 20 and to guide the cap between the cap supply position B, visible in FIG. 3A, and a cap pick-up position C, visible in FIG. 3B. In the shown embodiment, the cap guide arc provides a recessed guide along which the caps may be guided.

The turret assembly 40 is rotatable about an essentially vertical rotation axis R, which is provided along and adjacent to the spout supply position A, the cap supply position B and the cap guide arc 30. The turret assembly 40 passes, in the direction of rotation, the cap supply position B, visible in FIG. 3A, the cap pick-up position C, visible in FIG. 3B, an assembly position D, visible in FIG. 3C in which cap 3 and spout 2 are assembled and an assembled cap-and-spout expelling position E wherein the assembled cap-and-spout 100 is expelled from the turret assembly 40. In FIG. 3E, it is visible that in an embodiment, the assembly machine may further comprise an inspection system 50 at an inspection position I between the assembly position D and the expelling position E in which the assembled cap-and-spout 100 is inspected for anomalies.

The turret assembly 40 of the shown embodiment comprises, when seen from below to top, a circular spout transporter 41, a spout fixation member 44 and a cap positioning element 42. Furthermore, a cap assembly unit 43 is provided, which are all rotatable together as a turret assembly.

As schematically shown in FIG. 1, the stationary cap guide arc 30 is provided above and parallel to, and has the same radius as the spout transporter 41. The cap guide arc 30 has a limited length, in particular, it does not extend far beyond the cap pick-up position C. From this position, the cap 3 is held by a cap positioning element 42, and the guide is no longer required to support the cap 3.

The circular spout transporter 41 is adapted to transport each spout 2 at least between the spout supply position A, via the assembly position D, towards the expelling position E.

The circular spout transporter 41 is provided with spout receptacles, each adapted to receive a spout from the spout supply 10 at the spout supply position A. In the shown embodiment, the spout receptacles are embodied as pins 41*b* protruding through holes 41*a* in the spout transporter 41, in particular visible in FIG. 3E. The holes 41*a* are clearly visible, the pins 41*b* are allowed to extend through the holes to receive a spout 2 on the pin 41*b*, in particular to be inserted in the passage of the spout 2. This way, the bottom part of the spout 2 comprising the sealing walls rests on the pin and on the spout transporter 41 as visible in FIGS. 3C and 3D. Once the cap 3 is assembled onto the spout 2, as visible in FIGS. 3D and 3E the pin may be retracted below the spout transporter 41 to enable expelling of the assembled cap-and-spout from the assembly machine 1.

Figure 3C:
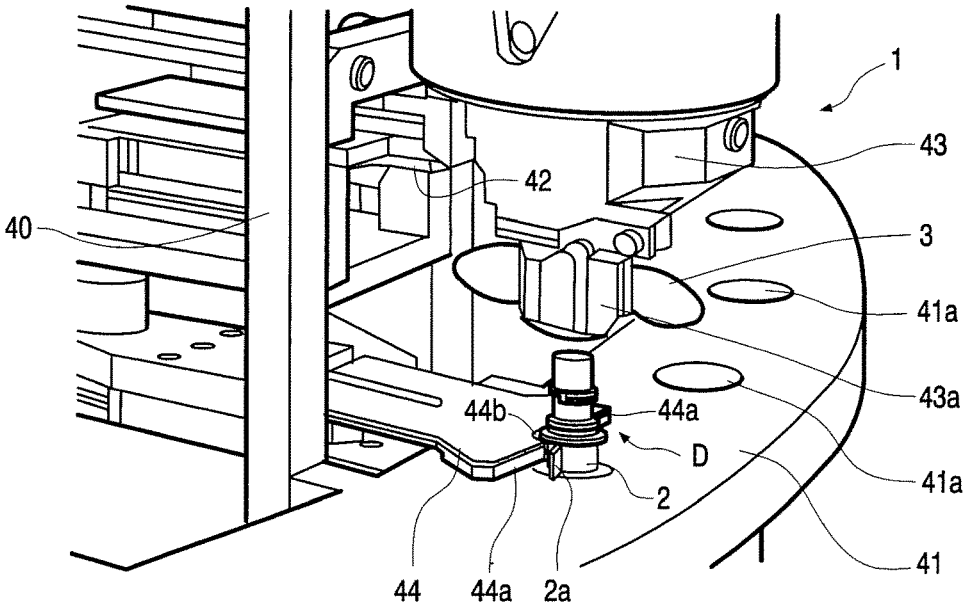
Figure 3D:
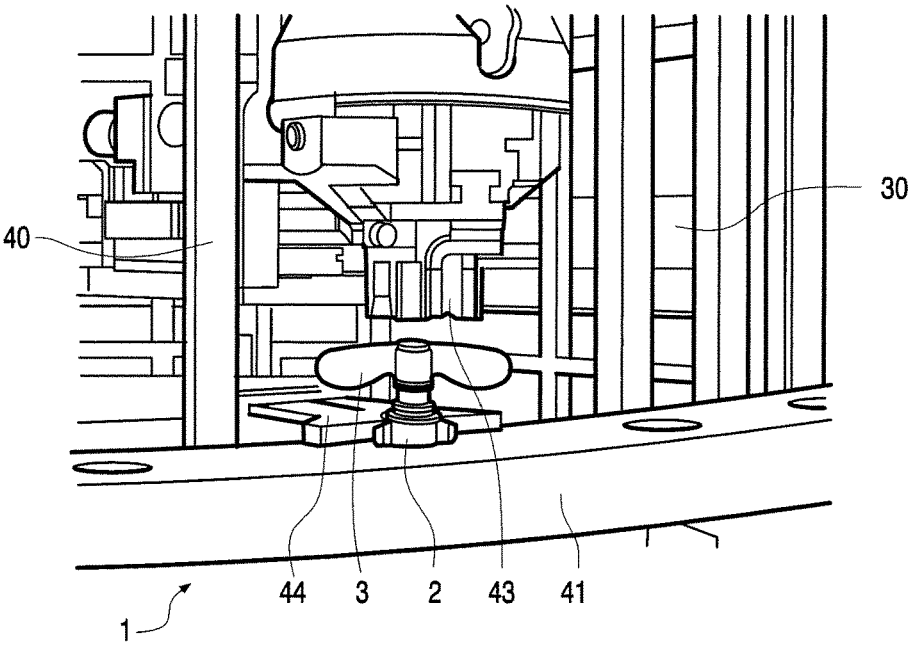
Figure 3E:
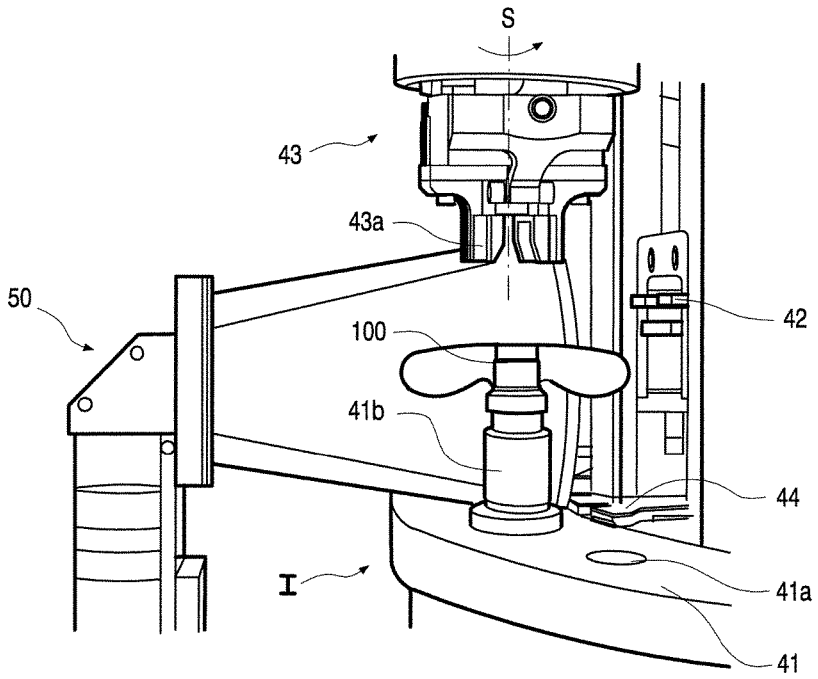

In the shown embodiment, a spout fixation member 44 is provided, visible in FIGS. 3C-3E, provided above and adjacent the spout transporter 41. The spout fixation member 44 of the shown embodiment has a forked configuration with blunt ends 44*a* between which an indentation 44*b* is provided. In the shown embodiment, the blunt ends 44*a* abut against winged portions 2*a* of the spout 2. The central portion of the lower part of the spout 2*b* comprising the passage is received in the indentation 44*b* of the spout fixation member.

In FIGS. 3A and 3B the cap positioning element 42 is visible, which in this embodiment is embodied similar to the spout fixation member 44, i.e., having a forked configuration with blunt edges 42*a* between which an indentation (not shown) is provided. The blunt edges 42*a* are allowed to abut against the wings 3*a* of the cap 3, while a central part 3*b* of the cap 3 is received in the indentation between the forks. The cap positioning element 42 is adapted to position the cap 3 in, and guide the cap 3 along the cap guide arc 30 in the operative position thereof between the cap supply position B and the cap pick-up position C, as shown in FIGS. 3A and 3B. As visible in FIG. 3B, once the position of the cap is controlled by the cap positioning element 42, the cap is allowed to be picked up by the cap assembly unit 43. Then, the function of cap guide arc 30 and cap positioning element 42 is moot, and hence the cap guide arc 30 is of limited length, and the cap positioning element 42 is retractable to a retracted non-operative position in FIGS. 3C-3E, when remote from the guide arc 30.

Both the spout fixation member 44 and the cap positing element 42 are retractable between an operative position wherein the spout fixation member 44 and the cap positing element 42 are adapted to fixate a spout 2 and the cap 3 respectively, to a non-operative retracted position. In particular, the spout fixation member is in the operative position at the assembly position D, as visible in FIG. 3C, and in the non-operative retracted position remote from the assembly position as shown in FIG. 3E.

The cap assembly unit 43 is provided movable up-and-down between a non-operative upper level as visible in FIG. 3A, at the cap supply position B, via a lower-situated pick-up level as visible in FIG. 3B at the cap pick-up position C, further downwards as visible in FIG. 3C to a lowermost assembly level at the assembly position D. In FIG. 3D, the cap assembly unit 43 has already moved upwards slightly, and even further to its non-operative upper level in FIG. 3E, similar to the level of the cap assembly unit 43 in FIG. 3A.

Cap assembly unit 43 is provided above the spout transporter 41, in particular above a spout receptacle of the spout transporter 41, and has a rotation path which is parallel to and has the same radius as the spout transporter 41. The cap assembly unit 43 is further adapted to pick up the cap 3 at the pick-up position C, visible in FIG. 3B, and assemble the cap 3 onto the spout 2 at the assembly position D, visible in FIGS. 3C and 3D. Due to its position above the spout transporter 41, the cap assembly unit 43 with the cap may operate on the spout while both the spout and the cap assembly unit 43 rotate with the turret. To this end, the cap assembly unit 43 is provided with an assembly head 43*a*, here a screw head, which is rotatable about a vertical rotation axis S. Advantageously, the orientation of the wings 3*a* of the cap 3 once assembled to the spout is accurately known due to the engagement with the screw head 43*a* of the cap assembly unit 43.

In an embodiment, the cap assembly unit 43 is a servo driven brushless motor. Advantageously, the cap assembly unit 43 is provided with a position controller to accurately control the position of the assembly head, here screw head 43*a* of the unit. In combination with the accurately controlled position of the cap 3, in particular the fragile wings 3*a* of the wing cap which is ascertained by the cap positioning element 42, the cap assembly unit 43 can come down at the cap pick-up position C in order to pick up the caps without damaging the wings 3*a* of the wing cap 3.

The invention claimed is:

1. Assembly machine (1) adapted to assemble caps (3) onto spouts (2), the assembly machine comprising:

a spout supply (10) adapted to supply spouts (2) in succession at a spout supply position (A);

a cap supply (20) adapted to supply caps (3) in succession at a cap supply position (B);

a frame comprising:

a cap guide arc (30), mounted stationary in the frame, which cap guide arc is adapted to receive each cap (3) from the cap supply (20) and to guide the cap between the cap supply position (B) and a cap pick-up position (C);

a turret assembly (40) which is rotatable about an essentially vertical rotation axis (R), which is provided along and adjacent to the spout supply position (A), the cap supply position (B) and the cap guide arc (30), the turret assembly passing, in the direction of rotation, the cap supply position (B), the cap pick-up position (C), an assembly position (D) in which cap and spout are assembled and an assembled cap-and-spout expelling position (E) wherein the assembled cap-and-spout is expelled from the turret assembly, the turret assembly (40) comprising:

a circular spout transporter (41), provided with spout receptacles (41*a*) each adapted to receive a spout from the spout supply (10) at the spout supply position (A), the spout transporter (41) being adapted to transport each spout at least between the spout supply position (A), via the assembly position (D), towards the expelling position (E), a cap positioning element (42) provided above the cap guide arc (30) in an operative position thereof, the stationary cap guide arc being provided above and parallel to and having the same radius as the spout transporter (41), the cap positioning element (42) being adapted to position the cap in, and guide the cap along the cap guide arc (30) in the operative position thereof between the cap supply position (B) and the cap pick-up position (C), the cap positioning element (42) being retractable to a non-operative retracted position when remote from the cap guide arc, a cap assembly unit (43) provided above the spout transporter (41), the rotation path of which being parallel to and having the same radius as the spout transporter (41), the cap assembly unit being adapted to pick up the cap at the pick-up position (C) and assemble the cap onto the spout at the assembly position (D), the cap assembly unit being movable up-and-down between a non-operative upper level, via a lower-situated pick-up level at the cap pick-up position (C) to a lowermost assembly level at the assembly position (D).

2. Assembly machine according to claim 1, wherein the cap is an anti-choke hazard wing cap and wherein the cap positioning element is allowed to abut the wings in the operative position thereof, to define the orientation of the wing cap at the pick-up position.

3. Assembly machine according to claim 1, the spout and/or cap supply comprising one or more of: a centrifugal feeder, a linear feeding line, a separation wheel.

4. Assembly machine according to claim 1, the turret assembly further comprising a spout fixation member provided adjacent the spout transporter, adapted to fixate a spout in an operative position at the assembly position, the spout fixation member being retractable to a non-operative retracted position remote from the assembly position.

5. Assembly machine according to claim 1, wherein the spout receptacles are embodied as pins or slides.

6. Assembly machine according to claim 1, adapted to assemble caps onto spouts to form a pre-assembled closure assembly that is to be sealed in an opening between two walls of a collapsible pouch.

7. Assembly machine according to claim 1, adapted to assemble caps onto spouts that have been sealed in an opening between two walls of a collapsible pouch.

8. Assembly machine according to claim 1, wherein the cap assembly unit is adapted to screw or click the cap onto the spout at the assembly position.

9. Method of assembling caps (3) onto spouts (2), wherein use is made of an assembly machine (1) according to claim 1, comprising the steps of:

supplying spouts (2) by a spout supply (10) in succession at a spout supply position (A);

supplying caps (3) by a cap supply (20) at a cap supply position (B);

a cap guide arc (3) receiving each cap (3) from the cap supply (20) and guiding the cap between the cap supply position (B) to a cap pick-up position (C);

a circular spout transporter (41) provided with spout receptacles (41*a*) receiving each spout from the spout supply (10) at the cap supply position (A) and transporting each spout at least from the spout supply position (A), via the assembly position (D), to the expelling position (E);

a cap positioning element (42) positioning the cap in, and guiding the cap along the cap guide arc (30) between the cap supply position (B) and the cap pick-up position (C);

the cap positioning element (42) retracting to a retracted position having a reduced radius when remote from the cap guide arc;

a cap assembly unit (43) moving down from a non-operative upper level, via a lower-situated pick-up level, picking up the cap at the pick-up position (C), to a lowermost assembly level, assembling the cap onto the spout at the assembly position (D);

expelling the assembled cap-and-spout from the turret assembly at the assembled cap-and-spout expelling position (E).

10. Method according to claim 9, preceded by the steps of:

sealing a spout in an opening between two walls of a collapsible pouch;

filling each of the collapsible pouches.

* * * * *